US006901777B2

(12) United States Patent
Bolduan et al.

(10) Patent No.: US 6,901,777 B2
(45) Date of Patent: Jun. 7, 2005

(54) WASHING MACHINE

(75) Inventors: Edwin Bolduan, Berlin (DE); Hans Günter-Felske, Berlin (DE); Horst Wiemer, Kleinmachnow (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 0 days.

(21) Appl. No.: 10/457,744

(22) Filed: Jun. 9, 2003

(65) Prior Publication Data

US 2004/0007029 A1 Jan. 15, 2004

Related U.S. Application Data

(63) Continuation of application No. PCT/EP01/14124, filed on Dec. 3, 2001.

(30) Foreign Application Priority Data

Dec. 8, 2000 (DE) ..... 100 61 237

(51) Int. Cl.[7] ..... D06F 33/02

(52) U.S. Cl. ..... 68/12.05; 68/12.04; 68/12.21; 68/208

(58) Field of Search ..... 68/12.05, 12.02, 68/12.04, 12.21, 208; 137/187

(56) References Cited

U.S. PATENT DOCUMENTS 5,272,892 A * 12/1993 Janutka et al. ..... 68/12.02
5,881,578 A 3/1999 Proppe et al.
6,481,246 B1 * 11/2002 Johnson et al. ..... 68/12.05

FOREIGN PATENT DOCUMENTS

DE 28 40 241 B1 3/1980
DE 3821306 * 12/1989
DE 196 52 830 A1 6/1998
DE 198 21 148 A1 11/1999
DE 198 58 386 A1 6/2000
EP 0 441 984 A1 8/1991
JP 60-119989 * 6/1985
JP 60-135092 * 7/1985
JP 60-135097 * 7/1985
JP 2-280793 * 11/1990
JP 3-133495 * 6/1991
JP 04244192 A 9/1992

OTHER PUBLICATIONS

Europena Patent Office 711, 860 May 1996.*
European Patent Office 11,448 Jun. 1984.*
WO98/12394 May 1998.*

* cited by examiner

*Primary Examiner*—Frankie L. Stinson
(74) *Attorney, Agent, or Firm*—John T. Winburn; Russell W. Warnock; Craig J. Loest

(57) ABSTRACT

A washing machine has a laundry drum and a tub and defines an outflow orifice at a lowest point and a second orifice at a point higher. An outflow line fluidically connects to the outflow orifice. A liquid line fluidically connects the outflow line to the second orifice. A turbidity sensor is disposed at the liquid line and responds to a turbidity of liquid flowing therethrough. A pressure controller includes a pressure line connection at the outflow line, a pressure sensor connected to the pressure line connection, a pressure of liquid in the outflow line dependent on a level of liquid in the tub being transmitted from the outflow line to the pressure line connection, and the pressure sensor responding to the liquid pressure and controlling a liquid filling level in the tub dependent upon the liquid pressure. In the configuration, the outflow hose has both a connection for a turbidity sensor and a connection for a pressure sensor.

13 Claims, 2 Drawing Sheets

WASHING MACHINE

CROSS-REFERENCE TO RELATED APPLICATION

This application is a continuation of copending International Application No. PCT/EP01/14124, filed Dec. 3, 2001, which designated the United States and was not published in English.

BACKGROUND OF THE INVENTION

FIELD OF THE INVENTION

The invention relates to a washing machine containing a tub in which a laundry drum is rotatable about a horizontal axis and having an outflow orifice at a lowest point, an outflow line connected to the outflow orifice and connected or connectable to a suds pump, a turbidity sensor on a liquid line that connects the outflow line to an additional orifice formed in the tub at a higher point than the outflow orifice, the turbidity sensor responding to the turbidity of the liquid that flows through the liquid line, and a pressure sensor that responds to a liquid pressure dependent on the liquid level in the tub to control the liquid filling level in the tub.

Such a washing machine exists. The turbidity sensor is what is referred to as a rinsing sensor, as a function of the signals of which laundry rinsing operations are controlled. The pressure sensor is connected to a further additional orifice of the tub through a pressure line.

German Published, Non-Prosecuted Patent Application DE 28 40 241 A discloses a washing machine outflow connection piece, to which a pressure sensor is connected through a pressure transmitter tube. A rinsing sensor is not disclosed in this application. The pressure sensor is a diaphragm switch that controls the water level in the tub, in particular, limits the water level to a predetermined value.

German Published, Non-Prosecuted Patent Application DE 196 52 830 A1, corresponding to U.S. Pat. No. 5,881,578 to Proppe et al., discloses a washing machine with a sensor in a liquid line that connects an additional orifice of the tub to the outflow line of the tub at a point that is lower than the additional orifice. A pressure sensor is not disclosed in this application. The sensor is, preferably, an optical sensor that contains a light transmitter, for example, an infrared LED transmitter, and a light receiver, for example, a phototransistor. Depending on the degree of turbidity of the liquid in the liquid line, more or less light from the transmitter passes through the liquid as far as the receiver. Other known techniques that can generate a signal as a function of the turbidity of the suds in the tub may, of course, also be used as a rinsing sensor.

SUMMARY OF THE INVENTION

It is accordingly an object of the invention to provide a washing machine that overcomes the hereinafore-mentioned disadvantages of the heretofore-known devices of this general type and that provides, in structural and production terms, a simpler and more cost-effective system. In particular, a smaller number of components is achieved and a modular principle, in which subassemblies can be premounted, becomes possible.

With the foregoing and other objects in view, there is provided, in accordance with the invention, a washing machine, including a tub having a lowest point and defining an outflow orifice at the lowest point and a second orifice at a point higher than the outflow orifice, a laundry drum rotatably disposed in the tub about a horizontal axis, an outflow line fluidically connected to the outflow orifice and to be connected to a suds pump, a liquid line fluidically connecting the outflow line to the second orifice, a turbidity sensor disposed at the liquid line, the turbidity sensor responding to a turbidity of liquid flowing through the liquid line, a pressure sensor, the outflow line having a pressure line connection connected to the pressure sensor and through which a pressure of liquid in the outflow line dependent on a level of liquid in the tub can be transmitted from the outflow line to the pressure sensor, and the pressure sensor responding to the liquid pressure and controlling a liquid filling level in the tub dependent upon the liquid pressure.

The washing machine is, accordingly, characterized by providing the outflow line for the pressure sensor with a pressure line connection, through which the liquid pressure can be transmitted from the outflow line to the pressure sensor.

The invention avoids the situation where a connection at the tub is necessary for the pressure sensor. Such a connection at the tub not only is costly in terms of production, but also prevents the possibility of using the same type of tub for a multiplicity of different washing machines. By virtue of the invention, a pressure sensor connection at the tub is no longer necessary so that tubs can be produced in large quantities for different types of washing machines.

In accordance with another feature of the invention, the outflow line has a side, the liquid line is connected to the outflow line at a connection, and the pressure line connection and the connection are provided on the side.

In accordance with a further feature of the invention, the liquid line is connected to the outflow line at a connection and the pressure line connection and the connection are provided on the same side of the outflow line.

According to the invention, both the connection for the rinsing sensor and the connection for the pressure sensor are formed on the outflow hose. Preferably, the two connections are disposed tangentially on the outflow hose, in particular, on the same side of the outflow hose. As a result, short line paths and sufficient free space for other appliance parts, such as, for example, the suds pump, are achieved in the washing machine. Furthermore, the invention makes it possible to construct the outflow hose, together with the connections for the turbidity sensor and for the pressure sensor, as a premounted subassembly that can be used on the modular principle for different types of washing machines.

In accordance with an added feature of the invention, the pressure line connection is formed directly adjacent the outflow orifice of the tub at the outflow line.

In accordance with an additional feature of the invention, the liquid line is connected to the outflow line at a connection and the connection is formed directly adjacent the outflow orifice of the tub.

In accordance with yet another feature of the invention, the liquid line is connected to the outflow line at a connection and the outflow line, the pressure line connection, and the connection are a one-piece body.

In accordance with yet a further feature of the invention, the one-piece body is of a flexible material. Preferably, the one-piece body is of rubber.

In accordance with yet an added feature of the invention, the turbidity sensor is a rinsing sensor for controlling laundry rinsing operations.

In accordance with yet an additional feature of the invention, the pressure sensor is a diaphragm switch.

In accordance with again another feature of the invention, there is provided a suds pump, the outflow line being fluidically connected to the suds pump.

With the objects of the invention in view, in a washing machine having a tub having a lowest point and defining an outflow orifice at the lowest point and a second orifice at a point higher than the outflow orifice, a laundry drum rotatably disposed in the tub about a horizontal axis, an outflow line fluidically connected to the outflow orifice and to be connected to a suds pump, a liquid line fluidically connecting the outflow line to the second orifice, and a turbidity sensor disposed at the liquid line, the turbidity sensor responding to a turbidity of liquid flowing through the liquid line, there is also provided a water level pressure controller including a pressure line connection at the outflow line, a pressure sensor connected to the outflow line at the pressure line connection, a pressure of liquid in the outflow line dependent on a level of liquid in the tub being transmitted from the outflow line to the pressure sensor through the pressure line connection, and the pressure sensor responding to the liquid pressure and controlling a liquid filling level in the tub dependent upon the liquid pressure.

With the objects of the invention in view, there is also provided a water level pressure controller, including an outflow line having an outflow orifice to be disposed at a lowest point of a tub for holding a liquid, and a pressure line connection, a pressure sensor connected to the outflow line at the pressure line connection, a pressure of the liquid in the outflow line dependent on a level of the liquid in the tub being transmitted from the outflow line to the pressure sensor through the pressure line connection, and the pressure sensor responding to the liquid pressure and controlling a liquid filling level in the tub dependent upon the liquid pressure.

Other features that are considered as characteristic for the invention are set forth in the appended claims.

Although the invention is illustrated and described herein as embodied in a washing machine, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
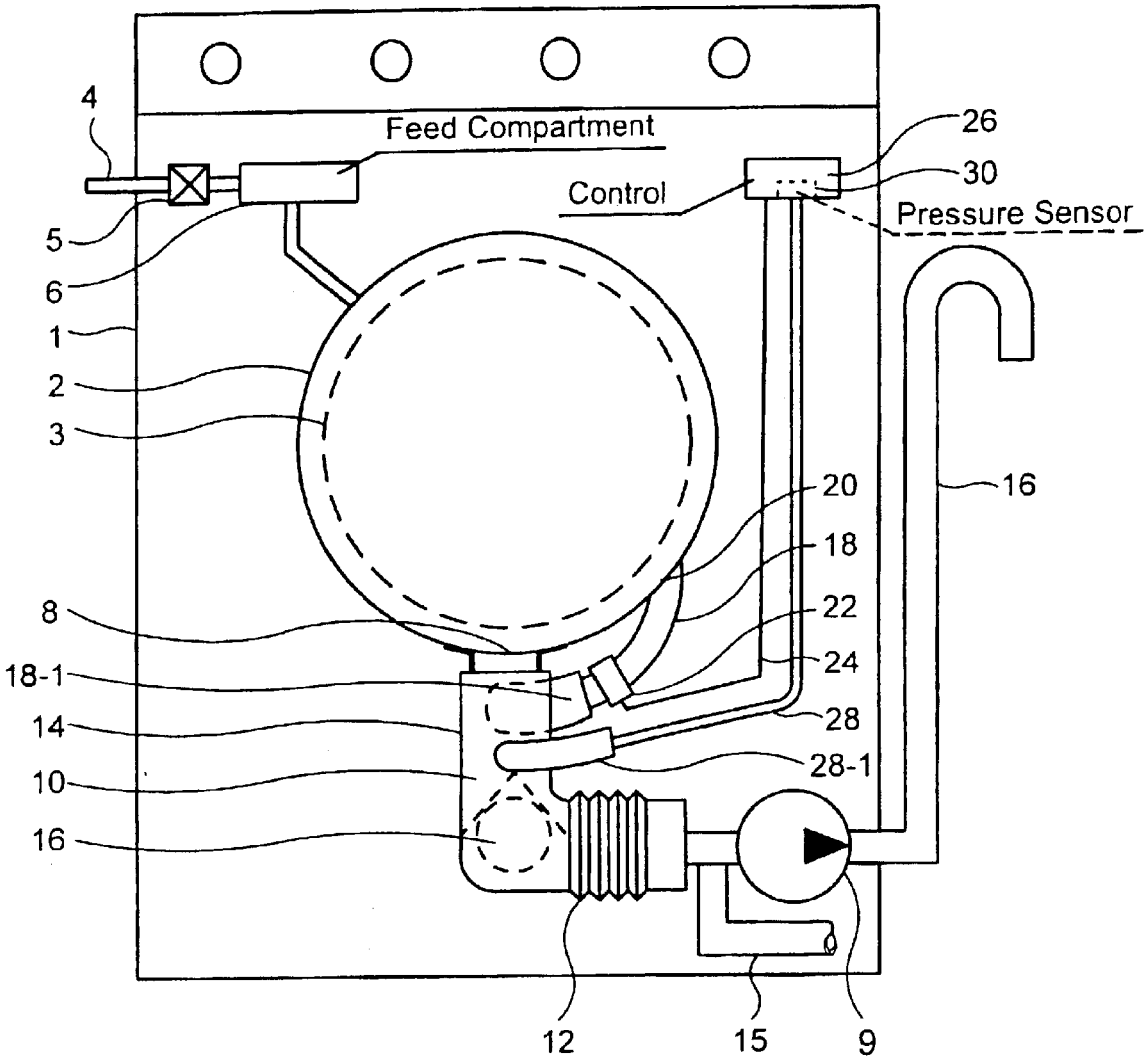
FIG. 1 is an elevational and partially hidden view of a diagrammatic representation of parts of a washing machine according to the invention.

Referring now to the figures of the drawings in detail and first, particularly to FIG. 1 thereof, there is shown a washing machine having a housing 1, in which a tub 2 is mounted in an oscillatory manner. A laundry drum 3 is disposed rotatably about a horizontal axis in the tub 2. Water and, if appropriate, laundry treatment agent (washing agent, rinsing agent, bleaching agent) may be supplied to the tub 2, in the upper part, from a supply line 4 through a solenoid valve 5 and a washing agent feed compartment 6. The tub 2 is provided at its lowest point with an outflow orifice 8, to which is connected in a liquid-tight manner an outflow hose or line 10 that has at its end remote from the tub 2 a particularly easily pliable downstream end portion 12 that is, preferably, concertina-shaped or in the manner of a corrugated tubular hose and that is connected to the suction side of a suds pump 9. A pumping-out hose 16 is connected to the delivery side of the suds pump 9. The downstream outflow hose portion 12 is formed on an substantially horizontal line leg of the outflow line 10.

The upstream portion 14 connected to the outflow orifice 8 of the tub 2 is, preferably, a vertical leg 14 of the outflow line 10. The outflow line 10 may contain a non-return valve 16 that prevents a return flow from the suds pump 9 into the outflow orifice 8 of the tub 2. The outflow line 10 may have a hose connection piece 18-1 for an emergency emptying hose in the event that the suds pump 9 has a defect.

A liquid line 18 connects an additional orifice 20 of the tub 2, the additional orifice 20 being located higher than the outflow orifice 8, to the vertical leg 14 of the outflow hose 10 at a point located between its non-return valve 16 and its upper end facing the outflow orifice 8. During the operation of the washing machine, suds or water can flow constantly through this liquid line 18 based upon a slight pressure difference of the suds between the outflow orifice 8 and the additional orifice 20.

The liquid line 18 is provided with a turbidity sensor 22 that, as a function of the turbidity of the liquid, in particular, suds, flowing through the liquid line 18, generates signals that are transmitted through a line 24 to a control unit 26 that can control the operation of the washing agent as a function thereof. Preferably, the turbidity sensor 22 is what is referred to as a "rinsing sensor," as a function of the signals of which laundry rinsing operations in the washing machine are controlled. This sensor 22 contains a transmitter and a receiver, for example, an optical transmitter, for example, an infrared LED, and an optical receiver, for example a phototransistor such as is known from German Published, Non-Prosecuted Patent Application DE 196 52 830 A1. However, a sensor that operates according to another measurement principle may also be used.

A pressure line 28 of a pressure sensor 30 of the control unit 26, for example, a diaphragm switch, connects the outflow hose 10 to the pressure sensor 30 at a point located between the non-return valve 16 of the outflow hose 10 and the upper end of the latter, which is connected to the outflow orifice 8. The pressure sensor 30 reacts as a function of the pressure that prevails in the outflow hose 10 and that, for its part, is dependent on the liquid level in the tub 2. As a result, by the pressure line 28 and its pressure sensor 30 or pressure switch, the liquid level in the tub 2 can be controlled, in particular, limited to a maximum value, as is known, for example, from German Published, Non-Prosecuted Patent Application DE 28 40 241 A.

The connections 18-1 and 28-1, provided in the outflow hose 10, of the liquid line 18 and of the pressure line 28 are formed in the vertical leg 14, preferably, directly adjacent to the outflow orifice 8, between the upper end of the outflow hose 10 and its non-return valve 16, preferably, by connection pieces that are an integral part of the outflow hose 10. The two connection pieces 18-1 and 28-1 are, preferably, disposed tangentially to the outflow hose 10. They may be configured one above the other according to FIG. 1 or in another way, the configuration one above the other having been chosen mainly to make them visible in FIG. 1.

Figure 2:
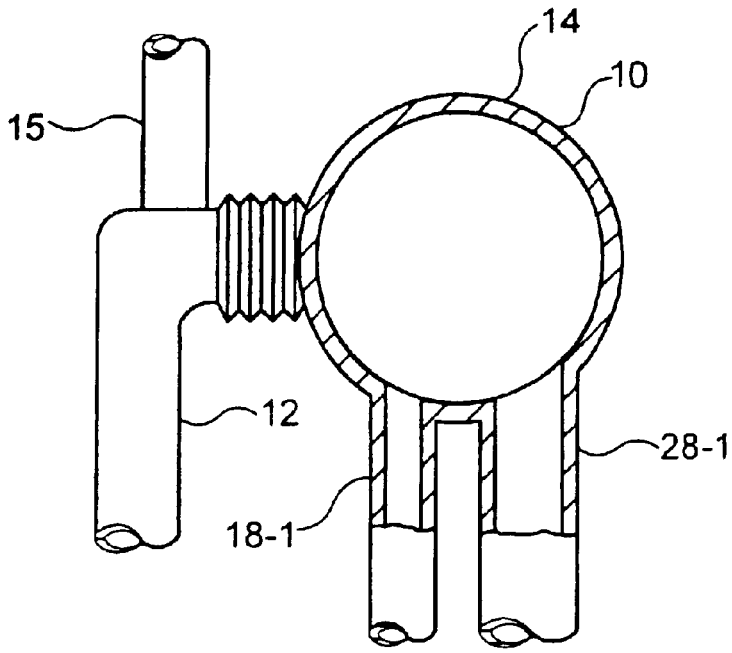
FIG. 2 is a fragmentary, elevational view and partially cross-sectional view through an outflow line system of the washing machine of FIG. 1.

FIG. 2 illustrates a preferred embodiment, in which the two connection pieces 18-1 and 28-1 are formed, substantially parallel and next to one another, in the vertical leg 14 of the outflow hose 10. This is a space-saving embodiment that, moreover, avoids the formation of harmful turbulent streams in the outflow hose.

Figure 3:
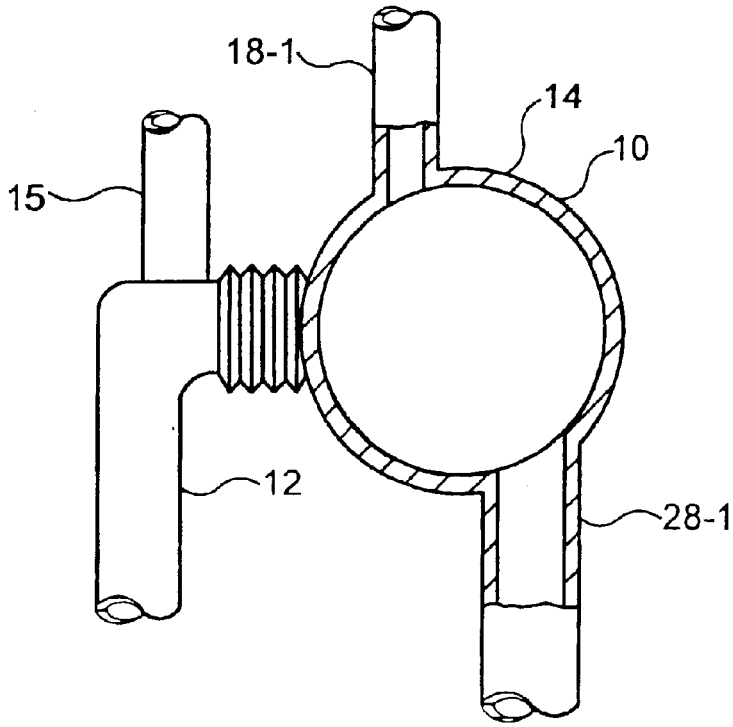
FIG. 3 is a fragmentary, elevational view and partially cross-sectional view through a further embodiment of the outflow system of the washing machine of FIG. 1.

FIG. 3 illustrates an embodiment in which the connection pieces 18-1 and 28-1 are, indeed, likewise disposed tangentially to the outflow hose 10 or its vertical leg 14, but on opposite sides of the outflow hose 10. This configuration could be more unfavorable than FIG. 2 in terms of the line routing in the washing machine and also in terms of flows in the outflow hose 10.

The outflow hose 10, preferably, is, in a known way, of a flexible material, for example, rubber, and, in a known way, is plugged onto or plugged to or otherwise releasably connected to the outflow orifice 8 of the tub 2.

We claim:

1. A washing machine, comprising:

a tub having a lowest point and defining:

an outflow orifice at said lowest point; and a second orifice at a point higher than said outflow orifice;

a laundry drum rotatably disposed in said tub about a horizontal axis;

an outflow line fluidically connected to said outflow orifice and to be connected to a suds pump;

a liquid line fluidically connecting said outflow line to said second orifice;

a turbidity sensor disposed at said liquid line, said turbidity sensor responding to a turbidity of liquid flowing through said liquid line;

a pressure sensor, said outflow line having a pressure line connection connected to said pressure sensor and through which a pressure of liquid in said outflow line dependent on a level of liquid in said tub can be transmitted from said outflow line to said pressure sensor; and said pressure sensor responding to the liquid pressure and controlling a liquid filling level in said tub dependent upon the liquid pressure.

2. The washing machine according to claim 1, wherein;

said outflow line has a side;

said liquid line is connected to said outflow line at a connection; and said pressure line connection and said connection are provided on said side.

3. The washing machine according to claim 1, wherein;

said liquid line is connected to said outflow line at a connection; and said pressure line connection and said connection are provided on the same side of said outflow line.

4. The washing machine according to claim 1, wherein:

said liquid line is connected to said outflow line at a connection; and said pressure line connection and said connection are each disposed approximately tangentially to said outflow line.

5. The washing machine according to claim 1, wherein said pressure line connection is formed directly adjacent said outflow orifice of said tub at said outflow line.

6. The washing machine according to claim 1, wherein:

said liquid line is connected to said outflow line at a connection; and said connection is formed directly adjacent said outflow orifice of said tub.

7. The washing machine according to claim 1, wherein:

said liquid line is connected to said outflow line at a connection; and said outflow line, said pressure line connection, and said connection are a one-piece body.

8. The washing machine according to claim 7, wherein said one-piece body is of a flexible material.

9. The washing machine according to claim 7, wherein said one-piece body is of rubber.

10. The washing machine according to claim 1, wherein said turbidity sensor is a rinsing sensor for controlling laundry rinsing operations.

11. The washing machine according to claim 1, wherein said pressure sensor is a diaphragm switch.

12. The washing machine according to claim 1, further comprising a suds pump, said outflow line being fluidically connected to said suds pump.

13. In a washing machine having:

a tub having a lowest point and defining:

an outflow orifice at the lowest point; and a second orifice at a point higher than the outflow orifice;

a laundry drum rotatably disposed in the tub about a horizontal axis;

an outflow line fluidically connected to the outflow orifice and to be connected to a suds pump;

a liquid line fluidically connecting the outflow line to the second orifice; and a turbidity sensor disposed at the liquid line, the turbidity sensor responding to a turbidity of liquid flowing through the liquid line;

a water level pressure controller comprising:

a pressure line connection at the outflow line;

a pressure sensor connected to the outflow line at said pressure line connection, a pressure of liquid in the outflow line dependent on a level of liquid in the tub being transmitted from the outflow line to said pressure sensor through said pressure line connection; and said pressure sensor responding to the liquid pressure and controlling a liquid filling level in the tub dependent upon the liquid pressure.

* * * * *